US006368079B2

(12) United States Patent
Peters et al.

(10) Patent No.: US 6,368,079 B2
(45) **Date of Patent: *Apr. 9, 2002**

(54) PIEZOELECTRIC MICROPUMP

(75) Inventors: Richard D. Peters, Gahanna; Chad E. Bouton; William C. Zimlich, Jr., both of Dublin, all of OH (US)

(73) Assignee: Battelle Pulmonary Therapeutics, Inc.

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/220,310

(22) Filed: Dec. 23, 1998

(51) Int. Cl.[7] ..... F04B 17/00
(52) U.S. Cl. ..... 417/413.2; 417/53
(58) Field of Search ..... 417/413.2, 322, 417/53, 244, 436, 413.1

(56) References Cited

U.S. PATENT DOCUMENTS 3,857,382 A * 12/1974 Williams, Jr. et al. ..... 128/1 D
4,231,287 A * 11/1980 Smiley ..... 92/94
4,938,742 A 7/1990 Smits ..... 604/67
5,096,388 A 3/1992 Weinberg ..... 417/322
5,611,676 A 3/1997 Ooumi et al. ..... 417/322

OTHER PUBLICATIONS http://www.acx.com/press_release_5.html, Dec. 1996.*

* cited by examiner

*Primary Examiner*—Henry C. Yuen
*Assistant Examiner*—Mahmoud Gimie
(74) *Attorney, Agent, or Firm*—Porter, Wright, Morris & Arthur

(57) ABSTRACT

A piezoelectric micropump is disclosed for pumping fluid from a container to a delivery point in low volumes and at controlled flow rates. The pumping action is created by movement of two or three diaphragms. The movement of each diaphragm is caused by expansion and contraction of an attached piezoelectric actuator. Coordination of the movement of the diaphragms creates unidirectional flow of the fluid. The piezoelectric actuators are cantilevered between the pump body and the diaphragms to provide greater deflection of the diaphragms. The piezoelectric actuators preferably are piezoelectric bimorphs such that the diaphragms can function as both seals and pumps.

37 Claims, 8 Drawing Sheets

PIEZOELECTRIC MICROPUMP

BACKGROUND OF THE INVENTION

1. Field of Invention

This invention pertains to the art of methods and apparatuses for pumping fluid from a container to a delivery point in low volumes and at controlled flow rates, and more specifically to methods and apparatuses for using a piezoelectric driven pump to control the delivery of a fluid, such as a pharmaceutical solution or suspension, from a container to a delivery point.

2. Description of the Related Art

Numerous fluidics applications in such areas as medicine, chemistry, and environmental testing exist on a small scale for reasons of sample size, reagent costs, or portability. Cost-effective fluidics components, including pumps, that are capable and reliable are required for such small scale systems. Current pump designs are typically based on valves that open and close. Such valves tend to be direct applications of designs that work in macroscopic apparatuses, but are not necessarily the best choice for microapplications. These apparatuses require valve seats or other types of sealing and anti-seizure mechanisms, and typically are limited to fully-opened clearances that are relatively small.

A number of micropumps exist for delivering small amounts of a fluid to a delivery point. Some of the pumps include a piezoelectric element, which changes its dimensions when it is stressed electrically by a voltage. U.S. Pat. No. 4,938,742 to Smits describes a micropump with piezoelectric valves. These valves contain a diaphragm covered by a single layer of piezoelectric material, which limits the control and deflection possibilities of the valves.

U.S. Pat. No. 5,611,676 to Ooumi et al. shows the use of a cantilevered piezoelectric bimorph. A piezoelectric bimorph has two layers of a piezoelectric material separated by a shim. The application of an electric field across the two layers of the bimorph causes one layer to expand while the other contracts. The net result is a curvature much greater that the length or thickness deformation of the individual layers. However, the micropump of Ooumi et al. uses the piezoelectric bimorphs only as single function seals for opening and closing openings or as single function pumps, not as multifunctional seals and pumps.

The present invention contemplates a new and improved piezoelectric micropump that is simple in design, effective in use and compact. The new and improved piezoelectric micropump provides increased fluid flow rates with low power consumption. It overcomes the foregoing difficulties and others while providing better and more advantageous overall results.

SUMMARY OF THE INVENTION

In accordance with the present invention, a new and improved piezoelectric micropump is provided that pumps fluid from a container to a delivery point in small and precise amounts or at controlled flow rates.

According to one aspect of the present invention, a micropump for pumping a fluid from a fluid container to a delivery point is disclosed that includes a pump body. A passageway extends through the pump body from the fluid container to the delivery point. The pump body has first, second, and third cavities intersecting with the passageway. A first diaphragm covers the first cavity and opens and closes the passageway as the first diaphragm is raised and lowered. A first diaphragm clamp secures the first diaphragm to the pump body. A first cantilevered piezoelectric actuator raises and lowers the first diaphragm. The first cantilevered piezoelectric actuator has a first end and second end, the first end being operatively connected to the first diaphragm. A first actuator clamp secures the second end of the first cantilevered piezoelectric actuator to the pump body. A second diaphragm covers the second cavity and opens and closes the passageway as the second diaphragm is raised and lowered. A second diaphragm clamp secures the second diaphragm to the pump body. A second cantilevered piezoelectric actuator raises and lowers the second diaphragm. The second cantilevered piezoelectric actuator has a first end and second end, the first end being operatively connected to the second diaphragm. A second actuator clamp secures the second end of the second cantilevered piezoelectric actuator to the pump body. A third diaphragm covers the third cavity. The third diaphragm opens and closes the passageway as the third diaphragm is raised and lowered. The third diaphragm is secured to the pump body by the first diaphragm clamp. A third cantilevered piezoelectric actuator raises and lowers the third diaphragm. The third cantilevered piezoelectric actuator has a first end and second end, the A first end being operatively connected to the third diaphragm, the second end of the third cantilevered piezoelectric actuator being secured to the pump body by the first actuator clamp. An electronic control circuit supplies voltages to the first, second, and third cantilevered piezoelectric actuators for raising and lowering the first, second, and third diaphragms at predetermined intervals, thereby promoting a flow of the fluid through the passageway.

According to another aspect of the present invention, a micropump for pumping a fluid from a fluid container to a delivery point is disclosed which includes a pump body having a passageway therethrough from the fluid container to the delivery point. The pump body has first and second cavities intersecting with the passageway. A first diaphragm covers the first cavity. The first piezoelectric actuator has a first end and second end, the first end being operatively connected to the first diaphragm. The first diaphragm opens and closes the passageway as the first diaphragm is raised and lowered in response to a first piezoelectric actuator. A second diaphragm covers the second cavity. The second diaphragm opens and closes the passageway as the second diaphragm is raised and lowered. A securing apparatus secures the first and second diaphragms to the pump body. A second piezoelectric actuator raises and lowers the second diaphragm. The second piezoelectric actuator has a first end and second end, the first end being operatively connected to the second diaphragm. The second ends of the first and second piezoelectric actuators are secured to the pump body with the first ends of the actuators being cantilevered from the pump body. An electrical apparatus applies voltages to the first and second piezoelectric actuators causing the first and second piezoelectric actuators to raise and lower the first and second diaphragms at predetermined intervals.

According to another aspect of the present invention, the micropump pump body has a third cavity intersecting with the passageway. The micropump further includes a third diaphragm covering the third cavity. The third diaphragm opens and closes the passageway as the third diaphragm is raised and lowered. The third diaphragm is secured to the pump body by the securing apparatus. A third piezoelectric actuator raises and lowers the third diaphragm. The third piezoelectric actuator has a first end and second end, the first end being operatively connected to the third diaphragm. The second end of the third piezoelectric actuator is secured to the pump body by the cantilever securing apparatus. The electrical apparatus applies a voltage to the third piezoelectric actuator causing the third piezoelectric actuator to raise and lower the third diaphragm.

According to another aspect of the present invention, a micropump for pumping a fluid from a fluid container to a delivery point is disclosed which includes a pump body. The pump body has a passageway therethrough from the fluid container to the delivery point. The pump body has first and second cavities intersecting with the passageway. A first pumping apparatus opens and closes the passageway at the first cavity and creates a vacuum for promoting the flow of the fluid through the passageway. A first piezoelectric actuator actuates the first pumping apparatus. A second pumping apparatus opens and closes the passageway at the second cavity and creates a vacuum for promoting the flow of the fluid through the passageway. A second piezoelectric actuator actuates the second pumping apparatus. An electrical apparatus applies voltages to the first and second piezoelectric actuators causing the first and second piezoelectric actuators to actuate the first and second pumping apparatuses.

According to another aspect of the present invention, the pump body has a third cavity intersecting with the passageway. The micropump further includes a third pumping apparatus that opens and closes the passageway at the third cavity and creates a vacuum for promoting the flow of the fluid through the passageway. A third piezoelectric actuator actuates the third pumping apparatus. The electrical apparatus applies a voltage to the third piezoelectric actuator causing the third piezoelectric actuator to actuate the third pumping apparatus.

According to another aspect of the present invention, a micropump for pumping a fluid from a fluid container to a delivery point is disclosed. The micropump has a pump a body having a passageway therethrough from the fluid container to the delivery point and first and second cavities intersecting with the passageway. The micropump includes first and second diaphragms covering the first and second cavities, respectively. The micropump further includes first and second piezoelectric actuators each having a first end and second end. The first ends of the actuators are operatively connected to the corresponding diaphragms and the second ends are connected to the pump body to define cantilever supports for the diaphragms. The pump also includes a power supply for selectively applying voltages to each of the first and second piezoelectric actuators, causing said first and second piezoelectric actuators to raise and lower the corresponding diaphragms. The first and second diaphragms each open and close the passageway as they are raised and lowered by the piezoelectric actuators.

The piezoelectric actuators in the above-described micropump may be piezoelectric bimorphs. In such a pump, the actuation of the first and second diaphragms controls both pumping and valving.

According to another aspect of the invention, a micropump for pumping a fluid from a fluid container to a delivery point is disclosed. The micropump has a pump body having a passageway therethrough from the fluid container to the delivery point and first and second cavities intersecting with the passageway. The micropump includes first and second diaphragms covering the first and second cavities, respectively. The micropump further includes first and second piezoelectric bimorphs each having first and second ends. The first ends are operatively connected to the first and second diaphragms, respectively, and the second ends are connected to the pump body. The micropump also includes a power supply for selectively applying voltages to each of the first and second piezoelectric actuators to raise and lower the corresponding diaphragms. The first and second diaphragms each open and close the passageway as they are raised and lowered by the piezoelectric actuators. Application of a voltage to the first piezoelectric actuator displaces the first diaphragm to define a first reservoir in the first cavity and draw fluid from the container through the inlet and into the first reservoir and application of an opposing voltage to the first piezoelectric actuator displaces the first diaphragm in an opposite direction to force fluid in the first reservoir into the passageway downstream from the first reservoir and seal the first cavity.

According to yet another aspect of the invention, application of a voltage to the second piezoelectric actuator in the above-described micropump displaces the second diaphragm to define a second reservoir in the second cavity and draw fluid from the passageway downstream of the first reservoir into the second reservoir and application of an opposing voltage to the second piezoelectric actuator displaces the second diaphragm in an opposite direction to force fluid in the second reservoir into the passageway downstream from the second reservoir and seal the second cavity.

According to another aspect of the present invention, a method of pumping a fluid from a container to a delivery point through a micropump is disclosed. The micropump includes a pump body having a passageway therethrough and first and second cavities intersecting the passageway, first and second diaphragms covering the first and second cavities, and first and second piezoelectric actuators cantilevered between the pump body and the first and second diaphragms to raise and lower the first and second diaphragms. The method includes the steps of actuating the first piezoelectric actuator to raise the first diaphragm, thereby allowing fluid to flow through the passageway from the container to the first cavity; actuating the second piezoelectric actuator to raise the second diaphragm and actuating the first piezoelectric actuator to lower the first diaphragm, thereby allowing fluid to flow through the passageway from the first cavity to the second cavity; and actuating the second piezoelectric actuator to lower the second diaphragm, thereby allowing fluid to flow through the passageway toward the delivery point.

According to another aspect of the present invention, the pump body has a third cavity intersecting the passageway and the micropump further includes a third diaphragm covering the third cavity and a third piezoelectric actuator for raising and lowering the third diaphragm. The method further includes the steps of actuating the third piezoelectric actuator to raise the third diaphragm while actuating the second piezoelectric actuator to lower the second diaphragm, thereby allowing fluid to flow through the passageway from the second cavity to the third cavity; and actuating the third piezoelectric actuator to lower the third diaphragm, thereby allowing fluid to flow through the passageway toward the delivery point.

One advantage of the present invention is that the micropump controls the flow of precise amounts of fluid, which is particularly advantageous for pharmaceuticals and other fluids to be dispensed in precise amounts or at controlled rates.

Another advantage of the present invention is that each of the piezoelectric actuator and diaphragm assemblies acts both a gate for the passageway of the micropump and a pump promoting the flow of the fluid through the micropump.

Another advantage of the present invention is that the flow rate of fluid may be controlled by varying the level of voltage applied to the piezoelectric actuators, thereby controlling the amount of deflection and the level to which the diaphragms are raised.

Another advantage of the present invention is that the flow rate of fluid may be controlled by varying the frequency of the pumping cycle of the piezoelectric actuators.

Another advantage of the present invention is that the gradual application of an increasing or decreasing voltage to the piezoelectric actuators stabilizes the flow of fluid through the micropump.

Another advantage of the present invention is that cantilevering the piezoelectric actuators between the pump body and the diaphragms provides increased deflection of the diaphragms compared with piezoelectric circular disks to maximize fluid flow while controlling power consumption.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
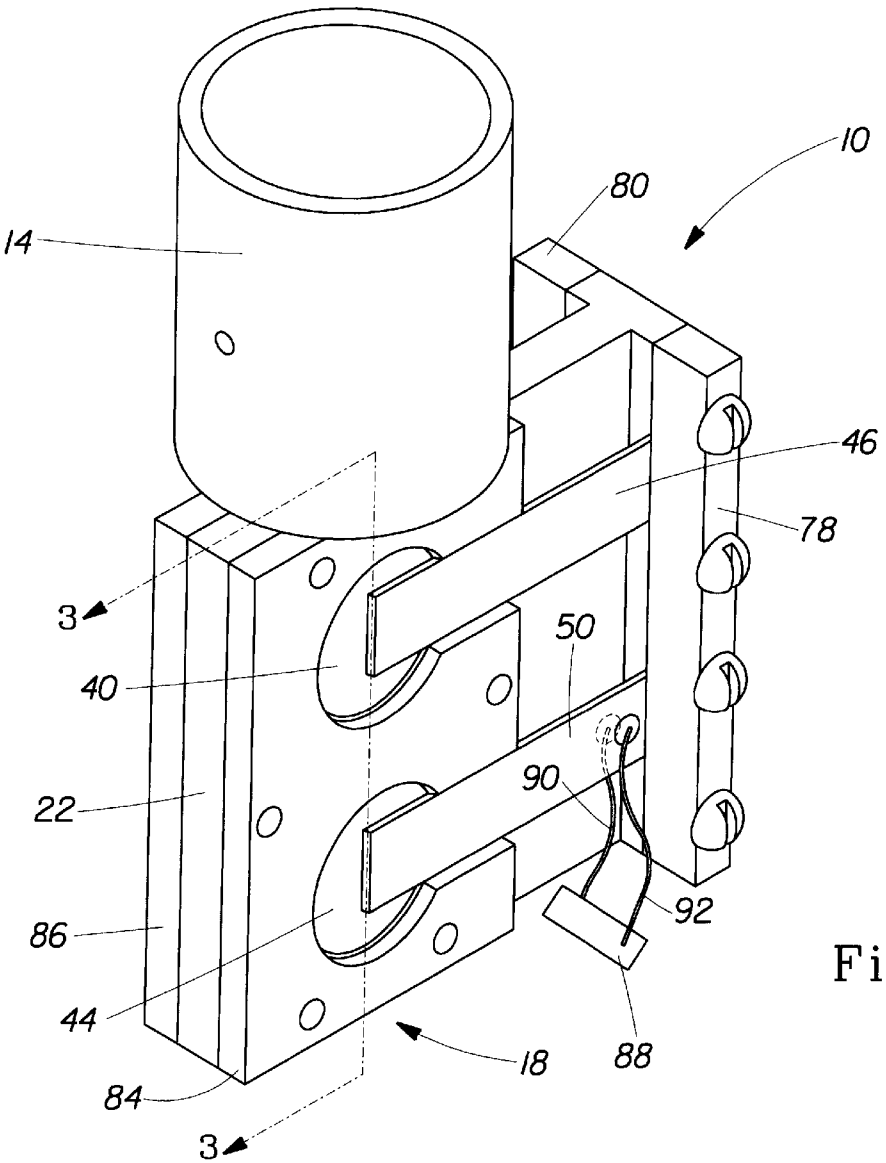
FIG. 1 is a perspective view of a piezoelectric micropump.

Referring now to the drawings which are shown only for purposes of illustrating a preferred embodiment of the invention and not for purposes of limiting the same, FIG. 1 is a perspective view of a micropump 10 for delivering precise amounts of a fluid from a container 14 to a delivery point 18. The micropump 10 includes a pump body 22. In a preferred embodiment, the pump body 22 is preferably made of molded or machined plastic such as Delrin.

For pharmaceutical or other applications, the pump body 22 may be made from an antimicrobial material or provided with an antimicrobial coating. The antimicrobial material and coating should be nonleaching. The pump body 22 and other components preferably are compatible with sterilization techniques so the micropump 10 may be packaged sterile.

Figure 2:
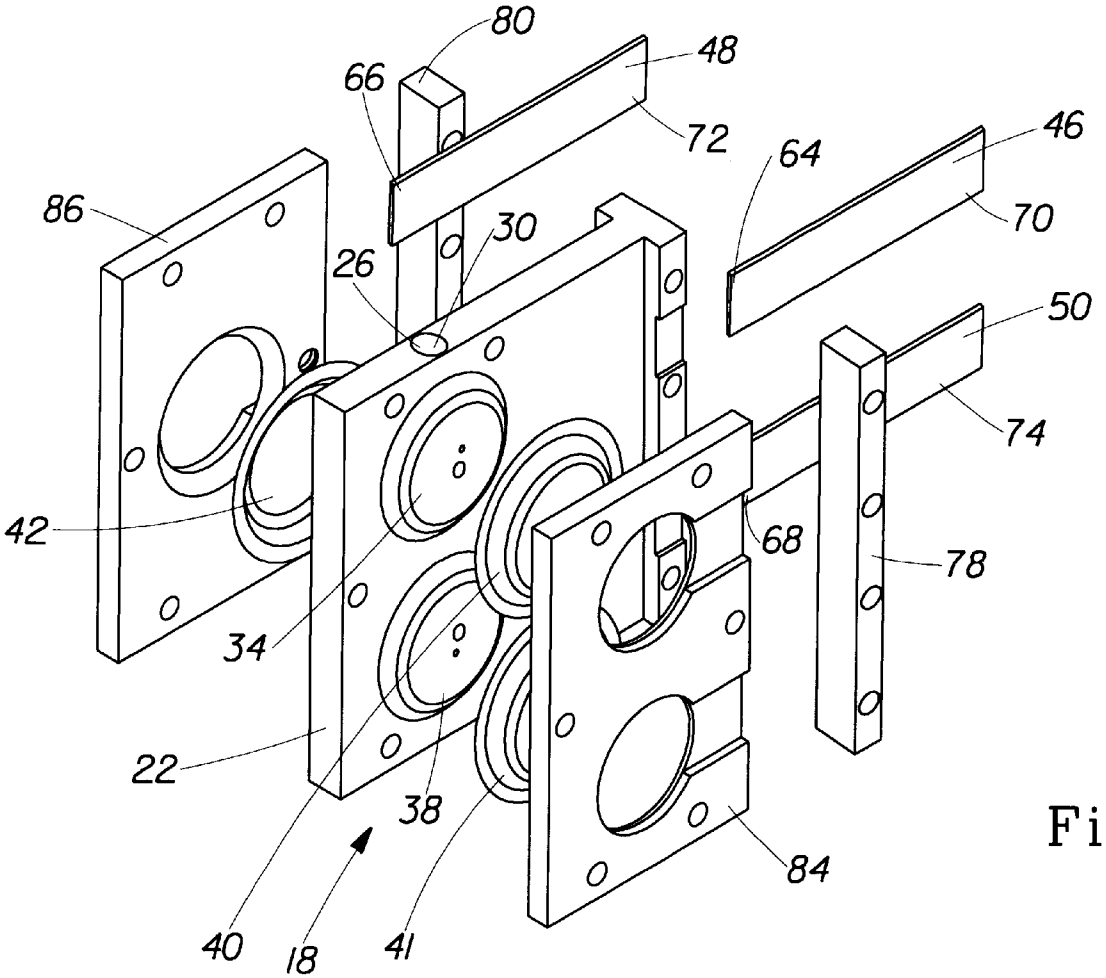
FIG. 2 is an exploded view of the piezoelectric micropump of FIG. 1.

With continuing reference to FIG. 1, FIG. 2 shows an exploded view of the micropump 10. Within the pump body 22 is a passageway 26. The passageway 26 preferably is molded or machined into the pump body 22 and is physically compatible with the fluids to be pumped including liquid solutions and microsuspensions. The passageway 26 and all other pump surfaces that come into contact with fluids are chemically compatible with the fluids to be pumped. The passageway 26 runs from an inlet 30 to which the container 14 is interchangeably connected, through the pump body 22, to an outlet 32, shown in FIG. 3, and the delivery point 18.

Figure 3:
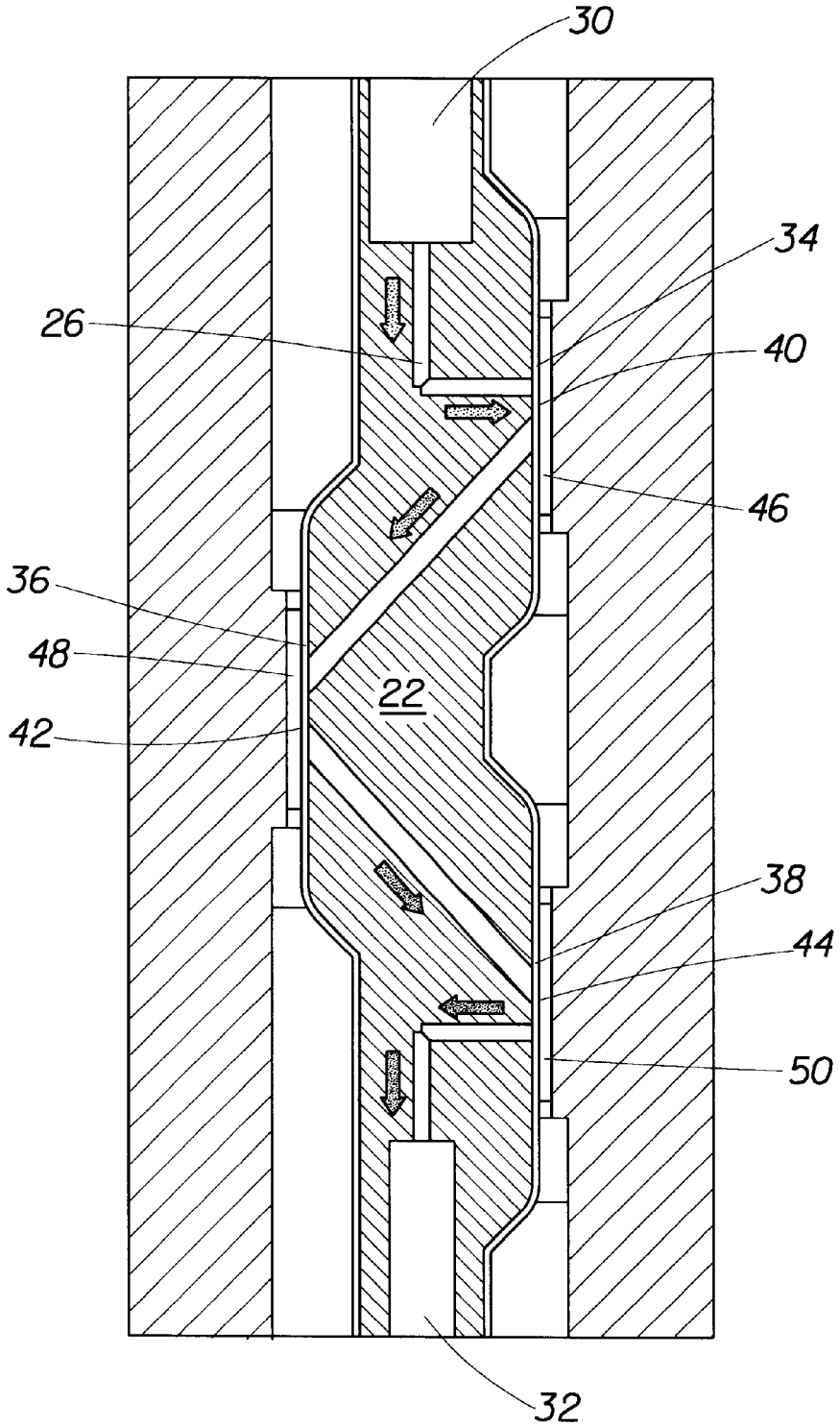
FIG. 3 is a cross-sectional view of the piezoelectric micropump of FIG. 1 taken along line 3—3.

As shown in FIG. 3, which is a cross-sectional view taken along line 3—3 of FIG. 1, with continuing reference to FIGS. 1 and 2, the passageway 26 runs from inlet 30 to outlet 32 through the pump body 22 in a preferably zig-zag fashion. The passageway 26 is intersected by and opened at three passageway cavities 34,36,38. These cavities 34,36,38 preferably are covered by nonleaching, elastomeric diaphragms 40,42,44. The diaphragms 40,42,44 preferably are made of silicone disks and may have a thickness of approximately 0.005 inch and a diameter of approximately 12 mm in a pump capable of pumping in the range of about 10–100 microliters/sec. When the diaphragms 40,42,44 are tightly secured against the pump body 22 in the cavities 34,36,38, the passageway 26 is closed at each of the cavities 34,36,38. When a diaphragm 40,42,44 is pulled away from its cavities 34,36,38, the corresponding portion of the passageway 26 is opened.

With continued reference to FIGS. 1, 2, and 3, the piezoelectric actuators 46,48,50 are attached to the diaphragms 40,42,44 at first ends 64,66,68, respectively. In the preferred embodiment, a silicone adhesive or other compatible adhesive is used to attach the diaphragms 40,42,44 to the piezoelectric actuators 46,48,50. However, any suitable method of attachment may be used. For example, the diaphragms 40,42, 44 may be provided with slots that receive the first ends of the piezoelectric actuators 46,48,50 or the diaphragms 40,42,44 and piezoelectric actuators 46,48,50 may be molded to form an integral piece.

The piezoelectric actuators 46,48,50 may be mounted to the pump body 22 by actuator clamps 78,80. In one embodiment of the present invention, actuator clamps 78,80 are pieces designed separately from pump body 22. However, actuator clamps 78,80 may also be formed integrally with pump body 22. The clamping of the second ends 70,72,74 of the piezoelectric actuators 46,48,50 to the pump body 22 creates a cantilever system of mounting. The cantilever system of mounting and the use of piezoelectric bimorphs are preferred for the piezoelectric actuators 46,48,50 to maximize the piezoelectric deflection achieved with a given applied voltage. When voltages are applied to the piezoelectric actuators 46,48,50, the second ends 70,72,74 remain stationary while the first ends 64,66,68 are displaced relative to the pump body 22, thereby raising and lowering the diaphragms 40,42,44. Deflecting one of the diaphragms 40,42,44 opens the corresponding portion of the passageway 26 that runs through the pump body 22. In the preferred embodiment, the diaphragms 40,42,44 are further held in contact with the pump body 22 in the cavities 34,36,38 by diaphragm clamps 84,86.

Figure 4:
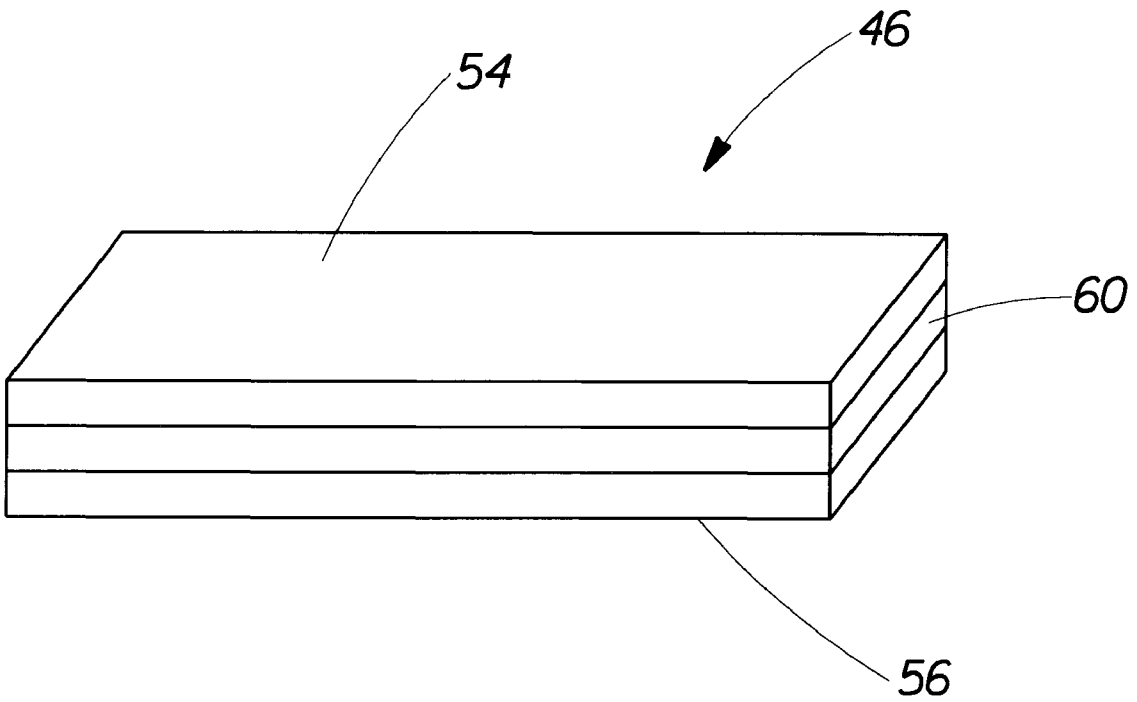
FIG. 4 is a side perspective view of a piezoelectric actuator.

The piezoelectric actuators 46,48,50 are preferably piezoelectric bimorph actuators. FIG. 4 is a detailed view of one of the piezoelectric actuators 46. The piezoelectric actuator 46 preferably contains two layers of piezoelectric ceramic 54,56 separated by a shim 60 preferably made of brass or an appropriate carbon fiber material. The application of an electric field across the two layers of piezoelectric ceramic material 54,56 causes one layer of piezoelectric ceramic 54 to expand while the other layer of piezoelectric ceramic 56 contracts. The net result is a curvature of much greater than the length or thickness definition of the individual piezoelectric ceramic members 54,56. The piezoelectric actuator 46 in a pump capable of pumping in the range of about 10–100 microliters per second may have a width of approximately 0.075 inch and a cantilevered length of approximately 1.0 inch. The preferred piezoelectric ceramics 54,56 are lead zirconate titanate, class 5H. Class 5A piezoceramics may also be used, but require higher voltages to achieve motion similar to class 5H piezoceramics. Use of piezoelectric bimorphs enables the diaphragms 40,42,44 to function as both seals and pumps. Displacement of one of the diaphragms 40,42,44 in one direction opens the corresponding cavity 34,36,38 to form a reservoir for fluid. Displacement of the diaphragm 40,42,44 in the opposite direction forces fluid out of the reservoir and the cavity 34,36,38.

With continuing reference to FIGS. 1, 2, and 3, FIGS. 5A through 5E show the pumping cycle of the micropump 10. Each diaphragm 40,42,44 is independently controlled by a piezoelectric actuator 46,48,50. During the pumping cycle, the piezoelectric actuators 46,48,50 cooperate to move the fluid in a unidirectional flow from the container 14 to the delivery point 18. The unidirectional flow and the sealing action of the diaphragms 40,42,44 maintain the integrity of the fluid.

Figures 5A, 5B, 5C, 5D, 5E:
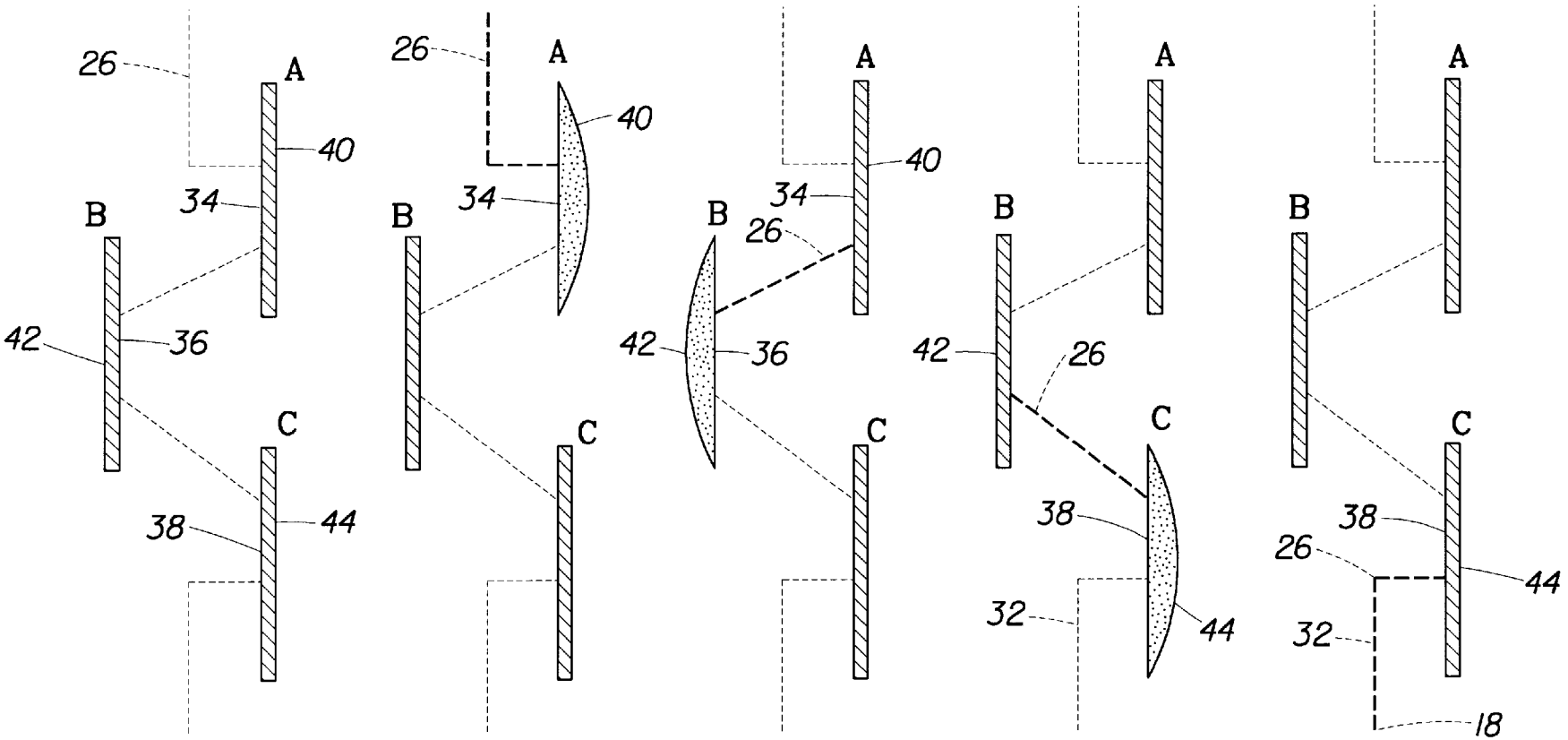
FIG. 5A–5E are schematic drawings illustrating the pumping cycle of the piezoelectric micropump.

When the micropump 10 is at rest, as shown in FIG. 5A, each of the diaphragms 40,42,44 is in its lowered position against the cavities 34,36,38, thereby closing passageway 26 at each of the cavities 34,36,38. In the first step of operation, as shown in FIG. 5B, the first diaphragm 40 is deflected or raised by applying a voltage to piezoelectric actuator 46, thereby displacing the first end 64 of the piezoelectric actuator 46. Raising diaphragm 40 creates a vacuum within the passageway 26 in cavity 34, thereby drawing fluid from the container 14 through the inlet 30 into a reservoir created in cavity 34 by the raised diaphragm 40. As used herein, "raising" a diaphragm means moving the diaphragm to an open or unsealed position although this movement need not be in an upward direction. Similarly, "lowering" a diaphragm means moving the diaphragm to a closed or sealed position although this movement need not be in a downward direction.

In FIG. 5C, step two of the pumping cycle is shown. A voltage is applied to piezoelectric actuator 48 to raise diaphragm 42, creating a vacuum in the passageway 26 at cavity 36. At the same time, an opposing voltage is applied to piezoelectric actuator 46, causing the first end 64 to lower diaphragm 40. The vacuum created by diaphragm 42 in cavity 36 and the lowering of diaphragm 40 causes a flow of the fluid from the reservoir created in cavity 34 to a reservoir created in cavity 36.

FIG. 5D shows the next step in the pumping cycle. A voltage is applied to piezoelectric actuator 50, causing the first end 68 of piezoelectric actuator 50 to raise diaphragm 44, creating a vacuum in cavity 38. Simultaneously, an opposing voltage is applied to piezoelectric actuator 48, causing first end 66 of piezoelectric actuator 48 to lower diaphragm 42 into the reservoir. The vacuum created by raising diaphragm 44 and the lowering of diaphragm 42 pushes fluid through passageway 26 to cavity 38.

FIG. 5E shows the final step of the pumping cycle. An opposing voltage is applied to piezoelectric actuator 50, lowering first end 68 of piezoelectric actuator 50 and lowering diaphragm 44. The lowering of diaphragm 44 forces the fluid from the reservoir created in cavity 38 through the passageway 26 and outlet 32 to the delivery point 18.

Figure 6:
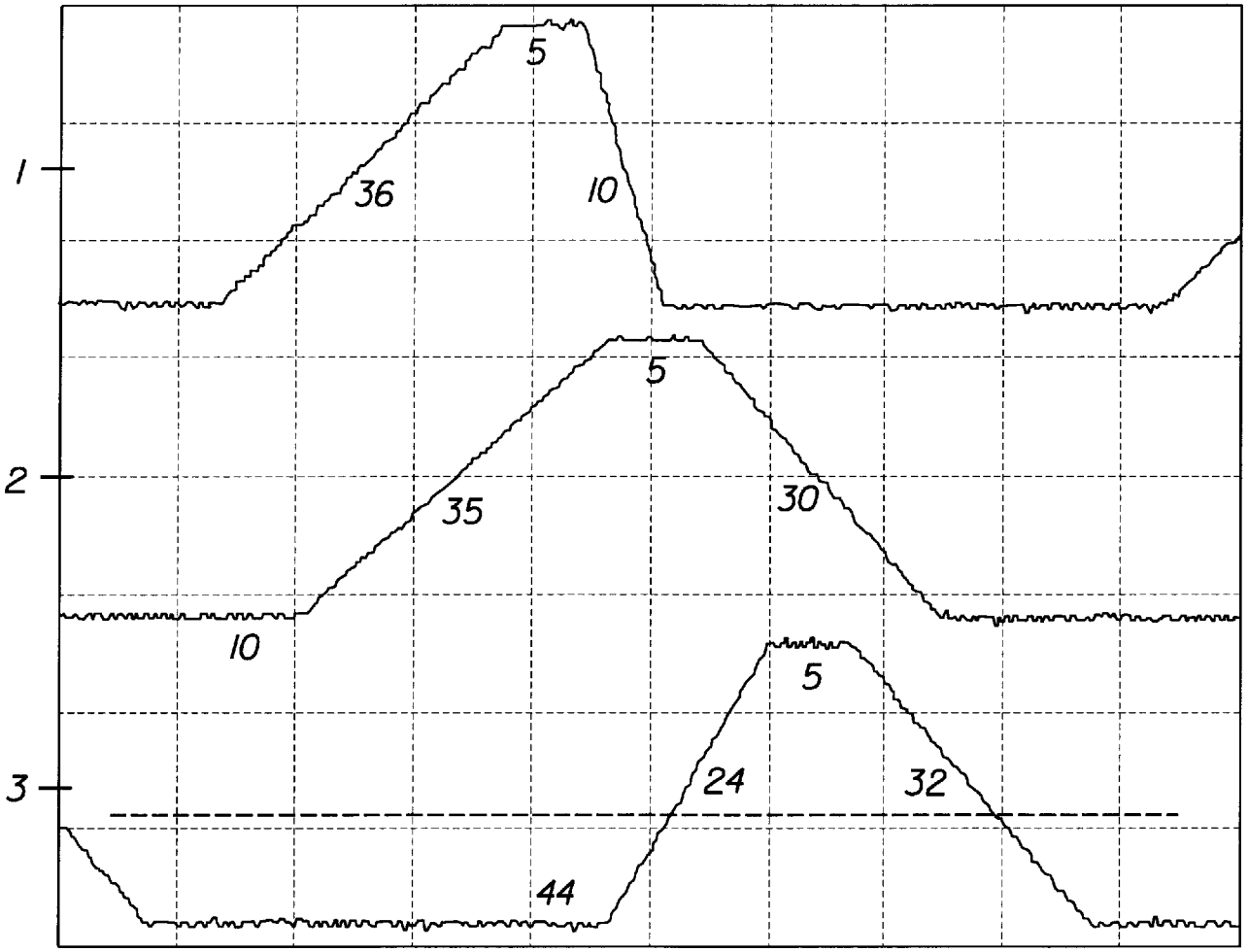
FIG. 6 is a graph of the waveforms of an electrical control circuit for an embodiment of the piezoelectric micropump.

FIG. 6 shows a graph of the application of voltages to the piezoelectric actuators 46,48,50 during a theoretical operation of the micropump 10 to pump water. The graph designated 1 shows the voltage applied to the first piezoelectric actuator 46. The graph designated 2 shows the voltage applied to the second piezoelectric actuator 48. The graph designated 3 shows the voltage applied to the third piezoelectric actuator 50. All three graphs 1,2,3 are shown together with time along the x-axis. Each of the voltages is applied in a gradually increasing manner as shown in the graphs 1,2,3 to prevent vibration of the actuators and audible noise during operation of the micropump 10 and to promote even flow through the passageway 26. The application of voltages to the piezoelectric actuators 46,48,50 is controlled by a control circuit 88, represented in FIG. 1, which is well known to those skilled in the art of electronics. The peak of graph 1 corresponds approximately to the step of the pumping cycle illustrated in FIG. 5B. The peak of graph 2 corresponds approximately to the step of the pumping cycle illustrated in FIG. 5C. The peak of graph 3 corresponds approximately to the step of the pumping cycle illustrated in FIG. 5D. The gradual increase in the voltage and the timing of the actuation of the various actuators helps to control unidirectional flow and minimize backflow. The wave forms and timing may vary depending on the fluid to be pumped and the desired fluid output.

In the preferred embodiment, the maximum voltage applied to the piezoelectric actuators 46,48,50 is 120 volts. If batteries are used to supply power to the piezoelectric actuators 46,48,50, the voltages of typical batteries must be stepped up by the control circuit 88 to provide sufficient voltages to create the piezoelectric effect in the piezoelectric actuators 46,48,50. In the preferred embodiment, the voltages are applied through leads 90,92, as shown in FIG. 1, that are attached to the piezoelectric actuators 46,48,50. However, any other suitable method of supplying the voltages to the piezoelectric actuators 46,48,50 may be used, including, but not limited to, the use of electrically conductive strips or other suitable materials.

The flow rate of fluid through the micropump 10 may be controlled by one of three methods or a combination of methods. The first, and preferred, method for controlling the flow rate of fluid through the micropump 10 is by increasing or decreasing the frequency of the pumping cycle. The frequency of the pumping cycle may be controlled by programming the control circuit 88 to speed up or slow down the application of voltages to the piezoelectric actuators 46,48,50.

The second method of controlling the flow rate of fluid through the micropump 10 is to control the level of voltage applied to the piezoelectric actuators 46,48,50. Applying a low voltage to the piezoelectric actuators 46,48,50 reduces the amount of deflection of the piezoelectric actuators 46,48,50, thereby limiting the height to which the diaphragms 40,42,44 are raised. The displacement of the diaphragms 40,42,44 in turn limits the vacuum created in the cavities 34,36,38 during the pumping cycle. The smaller the vacuums, the smaller the amounts of fluid drawn from the container 14 and moved through the pump 10.

The third method of controlling the flow rate of fluid through the micropump 10 is by controlling the diameter of the passageway 26. The greater the diameter of the passageway 26, the greater the amount of fluid that will flow through the micropump 10.

In the preferred embodiment of the invention, the flow rate of fluid through the micropump 10 is between about 10 microliters per second and 100 microliters per second. The precise motion of the piezoelectric actuators 46,48,50 provides tight tolerance at low flow rates. The use of multiple diaphragm cycles per dose provides tight tolerance at low volumes.

The container 14 may be an open reservoir as shown in FIG. 1, or the container 14 may be a sealed, collapsible container. If an open reservoir is used, the micropump 10 must be maintained in a generally upright orientation with the container 14 on top of the pump body 22. If a sealed, collapsible container is used, the micropump 10 may be used in a variety of orientations. However, the present model of the micropump 10 continues to work best when oriented with the container 14 on top of the pump body 22 even when a sealed, collapsible container is used. A change in orientation, along with the change in gravitational effects and head pressure that accompany the change in orientation, may affect the flow rate of fluid through the micropump 10.

Figure 7:
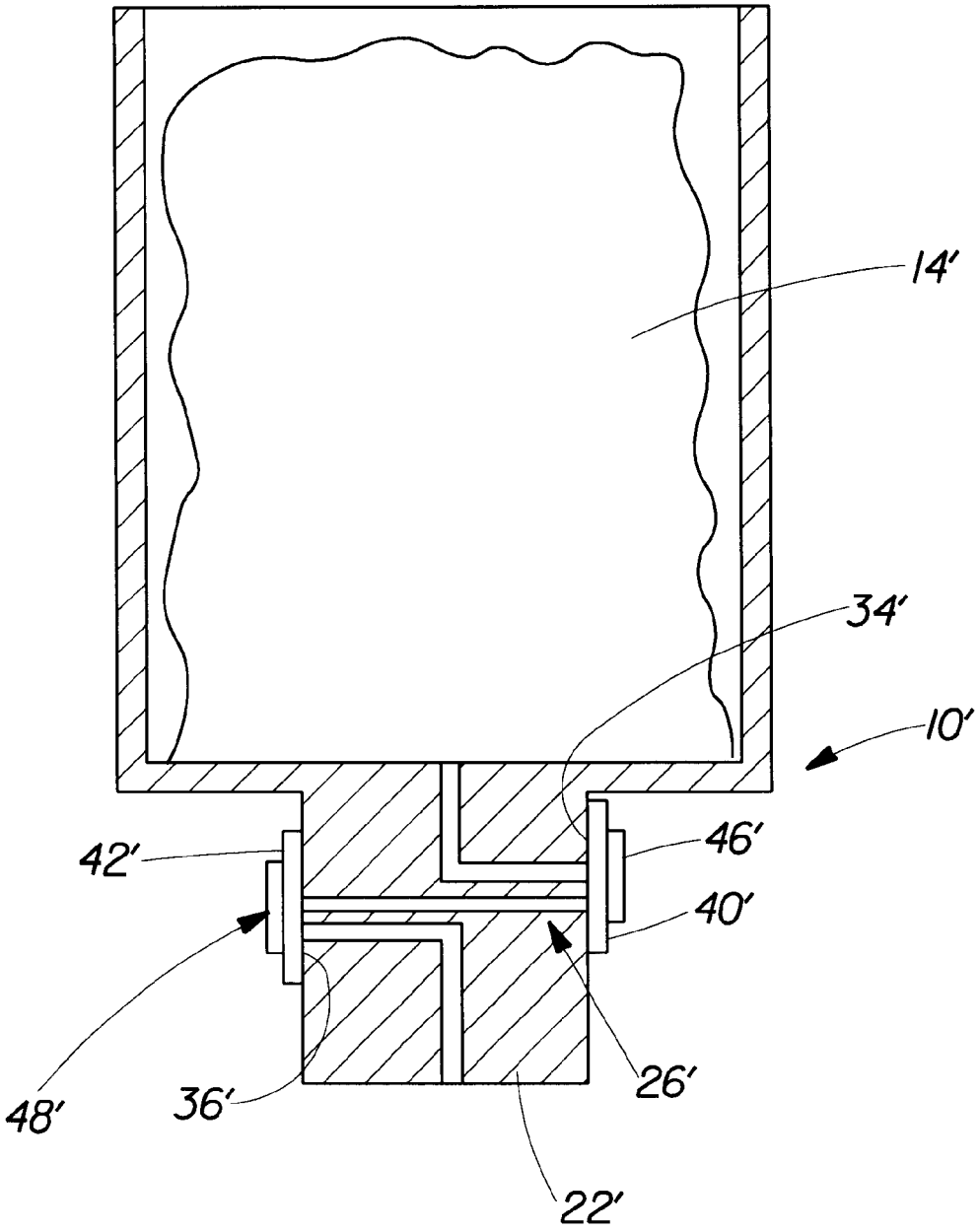
FIG. 7 is a side view of an alternate embodiment of the piezoelectric micropump with two diaphragms; and, FIG. 8 is a perspective view of an alternate embodiment of the piezoelectric micropump featuring means for purging the passageway of fluid.

FIG. 7 shows an alternate embodiment of the invention in which the micropump 10' features a pump body 22' with two cavities 34',36' that are covered by two diaphragms 40',42'. The two diaphragms 40',42' are attached to two piezoelectric actuators 46',48' that raise and lower the diaphragms 40',42'. The micropump 10' of FIG. 7 is operational and works in the same manner as micropump 10, but the micropump 10 with three diaphragms 40,42,44, as shown in FIGS. 1, 2, and 3, is preferred because it offers more control. The micropump 10' is also more susceptible to head pressure from the container 14' than the micropump 10 because the passageway 26' is completely open as fluid flows from the first cavity 34' to the second cavity 36'. Use of a fluid container under positive pressure with micropump 10' may overcome this problem.

The micropump 10 may include a purge feature to clear residual fluid from the passageway 26 after operation of the micropump 10. Purging the micropump 10 of fluid may be desirable to prevent microbial growth within the passageway 26, particularly near the outlet 32, or to prevent the buildup of residue within the passageway 26. As described below, the purge feature may include a apparatus for introducing a puring medium and causing the purging medium to travel through the passageway 26.

Figure 8:
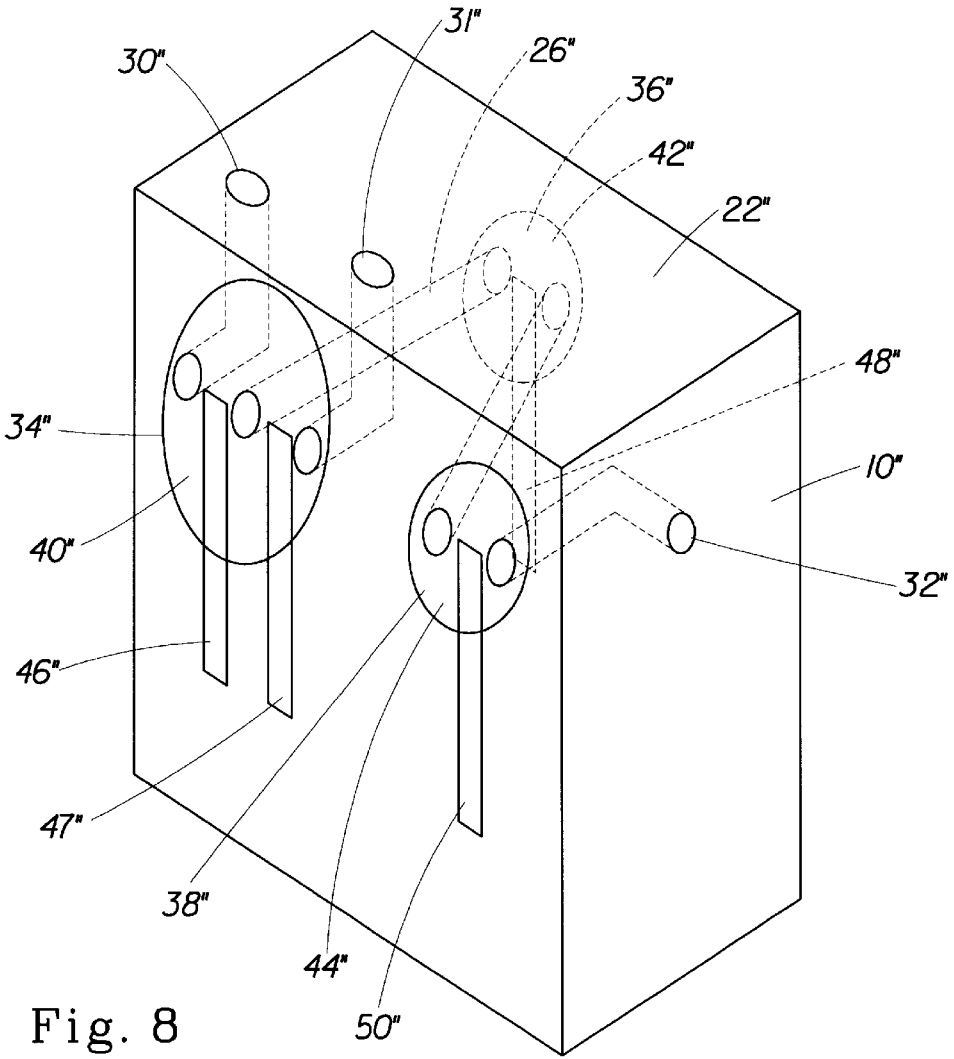

FIG. 8 shows an embodiment of the present invention incorporating means for purging the passageway 26" of fluid after operation of the micropump 10". The purge feature includes an inlet 31" for introducing a purging medium to the passageway 26". The pump body 22" has a passageway 26" running from an inlet 30" to an outlet 32". The passageway 26" is intersected by three passageway cavities 34", 36",38". These cavities 34",36",38" preferably are covered by elastomeric diaphragms 40",42",44". The second and third diaphragms 42",44" are each controlled by piezoelectric actuators 48",50" as described above. A second inlet 31" is also located within pump body 22" to the first cavity 34". A diaphragm 40" covers the first cavity 34". A first piezoelectric actuator 46" raises and lowers the diaphragm 40" over the portion of the passageway 26" leading to inlet 30" and a second piezoelectric actuator 47" raises and lowers the diaphragm 40" over the second inlet 31" and the portion of the passageway 26" that continues toward the second cavity 36". During operation of the micropump 10", piezoelectric actuators 46",48",50" raise and lower diaphragms 40" ,42", 44" as described in the previous embodiments.

Purging may be accomplished by introducing a purging medium, which may be filtered air, water, a cleansing fluid, or any other suitable material, into the micropump 10" through inlet 31" upon completion of the pumping cycle. During purging, piezoelectric actuator 46" seals the passageway 26" leading to the inlet 30". Three methods may be employed to move the purging medium through the passageway 26". First, the purging medium may be introduced through the second inlet 31" and pumped through the micropump 10" in the manner described above with the exception that piezoelectric actuator 47" raises and lowers diaphragm 40" in place of piezoelectric actuator 46". Second, the purging medium may be supplied under pressure through the second inlet 31" while actuators 47",48", 50" hold the diaphragms 40",42",44" open, thereby allowing the purging medium to blow through the passageway 26". Third, each of the diaphragms 40",42",44" may be held open by actuators 47",48",50", thereby allowing the purging medium to enter through inlet 31" and pass through the passageway 26" as a mechanism (not shown) at the outlet 32" pulls the purging medium therethrough. This mechanism may, for example, be an electrohydrodynamic spraying apparatus. While one method and apparatus for introducing a purging medium to the micropump 10" has been disclosed, it is understood that other methods and apparatuses for introducing purging media at or near the inlet 30" or first diaphragm 40" that is pumped, pushed, or pulled through the micropump 10" may be used.

In yet another embodiment of the present invention, the diaphragms 40,42,44 may be replaced by pistons or other pumiping apparatuses that move within the cavities 34,36,38 to induce fluid flow.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

We claim:

1. A micropump for pumping a fluid from a fluid container to a delivery point, comprising:

a pump body, said pump body having a passageway therethrough from said fluid container to said delivery point, said pump body having first, second, and third cavities intersecting with said passageway;

a first diaphragm covering said first cavity, said first diaphragm opening and closing said passageway as said first diaphragm is raised and lowered;

a first diaphragm clamp for securing said first diaphragm to said pump body;

a first cantilevered piezoelectric actuator for raising and lowering said first diaphragm, said first cantilevered piezoelectric actuator having a first end and second end, said first end being operatively connected to said first diaphragm;

a first actuator clamp for securing said second end of said first cantilevered piezoelectric actuator to said pump body;

a second diaphragm covering said second cavity, said second diaphragm opening and closing said passageway as said second diaphragm is raised and lowered;

a second diaphragm clamp for securing said second diaphragm to said pump body;

a second cantilevered piezoelectric actuator for raising and lowering said second diaphragm, said second cantilevered piezoelectric actuator having a first end and second end, said first end being operatively connected to said second diaphragm;

a second actuator clamp for securing said second end of said second cantilevered piezoelectric actuator to said pump body;

a third diaphragm covering said third cavity, said third diaphragm opening and closing said passageway as said third diaphragm is raised and lowered, said third diaphragm being clamped to said pump body by said first diaphragm clamp;

a third cantilevered piezoelectric actuator for raising and lowering said third diaphragm, said third cantilevered piezoelectric actuator having a first end and second end, said first end being operatively connected to said third diaphragm, said second end of said third cantilevered piezoelectric actuator being clamped to said pump body by said first actuator clamp; and, an electronic control circuit for supplying voltages to said first, second, and third cantilevered piezoelectric actuators for raising and lowering said first, second, and third diaphragms, thereby promoting a flow of said fluid through said passageway.

2. A micropump for pumping a fluid from a fluid container to a delivery point, comprising:

a pump body, said pump body having a passageway therethrough from said fluid container to said delivery point, said pump body having first and second cavities intersecting with said passageway;

a first diaphragm covering said first cavity, said first diaphragm opening and closing said passageway as said first diaphragm is raised and lowered;

a first piezoelectric actuator for raising and lowering said first diaphragm, said first piezoelectric actuator having a first end and second end, said first end being operatively connected to said first diaphragm;

a second diaphragm covering said second cavity, said second diaphragm opening and closing said passageway as said second diaphragm is raised and lowered;

securing means for securing said first and second diaphragms to said pump body;

a second piezoelectric actuator for raising and lowering said second diaphragm, said second piezoelectric actuator having a first end and second end, said first end being operatively connected to said second diaphragm;

cantilever securing means for securing said second end of said first piezoelectric actuator and said second end of said second piezoelectric actuator to said pump body in a cantilever manner; and, electrical means for applying voltages to said first and second piezoelectric actuators causing said first and second piezoelectric actuators to raise and lower said first and second diaphragms.

3. The micropump of claim 2 wherein said pump body has a third cavity intersecting with said passageway, said micropump further comprising:

a third diaphragm covering said third cavity, said third diaphragm opening and closing said passageway as said third diaphragm is raised and lowered, said third diaphragm being clamped to said pump body by said securing means;

a third piezoelectric actuator for raising and lowering said third diaphragm, said third piezoelectric actuator having a first end and second end, said first end being operatively connected to said third diaphragm, said second end of said third piezoelectric actuator being clamped to said pump body by said cantilever securing means in a cantilever manner, said electrical means applying a voltage to said third piezoelectric actuator causing said third piezoelectric actuator to raise and lower said third diaphragms.

4. The micropump of claim 3 wherein said first, second, and third piezoelectric actuators each comprise:

a first layer of piezoelectric material;

a second layer of piezoelectric material; and a shim separating said first and second layers.

5. The micropump of claim 4 wherein said shim is selected from brass and a carbon fiber composite.

6. The micropump of claim 4 wherein said electrical means comprises:

an electronic control circuit for supplying a voltage to said first, second, and third piezoelectric actuators for raising and lowering said first, second, and third diaphragms, thereby promoting a flow of said fluid through said passageway.

7. The micropump of claim 6 wherein said electronic control circuit further comprises:

means for gradually applying voltages to said first and second layers of each of said first, second, and third piezoelectric actuators.

8. The micropump of claim 2 wherein said cantilever securing means comprises a clamp for securing said first, second, and third diaphragms to said pump body.

9. The micropump of claim 2 wherein said cantilever securing means comprises:

a first actuator clamp for securing said second end of said first piezoelectric actuator and said second end of said third piezoelectric actuator to said pump body; and, a second actuator clamp for securing said second end of said second piezoelectric actuator to said pump body.

10. The micropump of claim 9 wherein said first and second actuator clamps are integral with said pump body.

11. The micropump of claim 2 wherein said electrical means comprises:

an electronic control circuit for supplying a voltage to said first and second piezoelectric actuators, said electronic control circuit gradually increasing the voltage applied to at least one of said piezoelectric actuators for raising the corresponding diaphragm and gradually decreasing the voltage applied to at least one of said piezoelectric actuators for lowering the corresponding diaphragm.

12. The micropump of claim 11 wherein the electronic control circuit selectively actuates and deactuates each of said first and second piezoelectric actuators such that said first and second diaphragms cooperate to promote a flow of fluid through said passageway.

13. The micropump of claim 2 wherein said piezoelectric actuators each have sides extending between said first and second ends and the head pressure of the micropump is dependent on the distance between said sides.

14. A micropump for pumping a fluid from a fluid container to a delivery point, comprising:

a pump body, said pump body having a passageway therethrough from said fluid container to said delivery point, said pump body having first and second cavities intersecting with said passageway;

first pumping means for opening and closing said passageway at said first cavity and creating a vacuum for promoting the flow of said fluid through said passageway;

a first piezoelectric actuator for actuating said first pumping means;

second pumping means for opening and closing said passageway at said second cavity and creating a vacuum for promoting the flow of said fluid through said passageway;

a second piezoelectric actuator for actuating said second pumping means;

electrical means for applying voltages to said first and second piezoelectric actuators causing said first and second piezoelectric actuators to actuate said first and second pumping means.

15. The micropump of claim 14 wherein said pump body has a third cavity intersecting with said passageway, said micropump further comprising:

third pumping means for opening and closing said passageway at said third cavity and creating a vacuum for promoting the flow of said fluid through said passageway;

a third piezoelectric actuator for actuating said third pumping means; and, electrical means for applying a voltage to said third piezoelectric actuator causing said third piezoelectric actuator to actuate said third pumping means.

16. The micropump of claim 15 wherein said first pumping means comprises a first piston engageable with said first cavity.

17. The micropump of claim 16 wherein said second pumping means comprises a second piston engageable with said second cavity.

18. The micropump of claim 17 wherein said third pumping means comprises a third piston engageable with said third cavity.

19. The micropump of claim 15 wherein said first pumping means comprises a first diaphragm engageable with said first cavity.

20. The micropump of claim 19 wherein said second pumping means comprises a second diaphragm engageable with said second cavity.

21. The micropump of claim 20 wherein said third pumping means comprises a third diaphragm engageable with said third cavity.

22. The micropump of claim 14, further including an open container in communication with the passageway.

23. The micropump of claim 14, further including a closed, sealed container in communication with the passageway.

24. The micropump of claim 14 wherein said electrical means comprises:

an electronic control circuit for supplying a voltage to said first and second piezoelectric actuators, said electronic control circuit gradually increasing the voltage applied to at least one of said piezoelectric actuators for causing the corresponding pumping means to open and gradually decreasing the voltage applied to at least one of said piezoelectric actuators for causing the corresponding pumping means to close.

25. The micropump of claim 14 wherein said piezoelectric actuators each have sides extending between said first and second ends and the head pressure of the micropump is dependent on the distance between said sides.

26. A method of pumping a fluid from a container to a delivery point through a micropump, said micropump comprising a pump body having a passageway therethrough and first and second cavities intersecting said passageway, first and second diaphragms covering said first and second cavities, and first and second piezoelectric actuators mounted in a cantilever manner attached to said first and second diaphragms to raise and lower said first and second diaphragms, said method comprising the steps of:

actuating said first piezoelectric actuator to raise said first diaphragm, thereby allowing fluid to flow through said passageway from said container to said first cavity;

actuating said second piezoelectric actuator to raise said second diaphragm and actuating said first piezoelectric actuator to lower said first diaphragm, thereby allowing fluid to flow through said passageway from said first cavity to said second cavity; and actuating said second piezoelectric actuator to lower said second diaphragm, thereby allowing fluid to flow through said passageway toward said delivery point.

27. The method of claim 26 wherein said pump body has a third cavity intersecting said passageway and said micropump further comprises a third diaphragm covering said third cavity and a third piezoelectric actuator for raising and lowering said third diaphragm, said method further comprising the steps of:

actuating said third piezoelectric actuator to raise said third diaphragm while actuating said second piezoelectric actuator to lower said second diaphragm, thereby allowing fluid to flow through said passageway from said second cavity to said third cavity; and, actuating said third piezoelectric actuator to lower said third diaphragm, thereby allowing fluid to flow through said passageway toward said delivery point.

28. The method of claim 26, further comprising the step of:

purging fluid from said passageway.

29. The method of claim 26, further comprising the steps of:

applying a gradually increasing voltage to selectively actuate said first and second piezoelectric actuators; and gradually decreasing the applied voltage to selectively deactuate said first and second piezoelectric actuators.

30. A micropump for pumping a fluid from a fluid container to a delivery point, comprising:

a pump body, said pump body having a passageway therethrough from the fluid container to the delivery point, said pump body having first and second cavities intersecting with said passageway;

a first diaphragm covering said first cavity, said first diaphragm opening and closing said passageway as said first diaphragm is raised and lowered;

a first piezoelectric bimorph actuator having a first end and second end, said first end being operatively connected to said first diaphragm and said second end being connected to said pump body;

a second diaphragm covering said second cavity, said second diaphragm opening and closing said passageway as said second diaphragm is raised and lowered;

a second piezoelectric bimorph actuator having a first end and second end, said first end being operatively connected to said second diaphragm and said second end being connected to said pump body; and, a power supply for selectively applying voltages to each of said first and second piezoelectric actuators, wherein application of a voltage to said first piezoelectric actuator displaces said first diaphragm to define a first reservoir in said first cavity and draw fluid from said container through said inlet and into said first reservoir and application of an opposing voltage to said first piezoelectric actuator displaces said first diaphragm in an opposite direction to force fluid in said first reservoir into said passageway downstream of said first diaphragm and seal said first cavity.

31. The micropump of claim 30 wherein application of a voltage to said second piezoelectric actuator displaces said second diaphragm to define a second reservoir in said second cavity and draw fluid from said passageway downstream of said first reservoir into said second reservoir and application of an opposing voltage to said second piezoelectric actuator displaces said second diaphragm in an opposite direction to force fluid in said second reservoir into said passageway downstream of said second reservoir and seal said second cavity.

32. The micropump of claim 31 wherein said power supply gradually applies a voltage to said second piezoelectric actuator to displace said second diaphragm and gradually applies an opposing voltage to said second piezoelectric actuator to displace said second diaphragm in an opposite direction.

33. The micropump of claim 30 wherein said power supply gradually applies a voltage to said first piezoelectric actuator to displace said first diaphragm and gradually applies an opposing voltage to said first piezoelectric actuator to displace said first diaphragm in an opposite direction.

34. The micropump of claim 33 wherein said piezoelectric actuators are piezoelectric bimorphs.

35. The micropump of claim 30, further comprising:

means for purging said passageway of fluid after the fluid is pumped from said fluid container to said delivery point.

36. A micropump for pumping a fluid from a fluid container to a delivery point, comprising:

a pump body, said pump body having a passageway therethrough from the fluid container to the delivery point, said pump body having first and second cavities intersecting with said passageway;

a first diaphragm covering said first cavity, said first diaphragm opening and closing said passageway as said first diaphragm is raised and lowered;

a first piezoelectric actuator having a first end and second end, said first end being operatively connected to said first diaphragm and said second end being connected to said pump body to define a cantilever support for said first diaphragm;

a second diaphragm covering said second cavity, said second diaphragm opening and closing said passageway as said second diaphragm is raised and lowered;

a second piezoelectric actuator having a first end and second end, said first end being operatively connected to said second diaphragm and said second end being connected to said pump body to define a cantilever support for said second diaphragm; and, a power supply for selectively applying voltages to each of said first and second piezoelectric actuators, said power supply gradually increasing the voltage applied to each of said first and second piezoelectric actuators to cause said first and second piezoelectric actuators to raise the corresponding diaphragms and gradually decreasing the voltage applied to each of said first and second piezoelectric actuators to cause said first and second piezoelectric actuators to lower the corresponding diaphragms.

37. The micropump of claim 36 wherein each of said piezoelectric actuators have sides extending between said first and second ends and the head pressure of the micropump is dependent on the distance between said sides.

* * * * *